US007762041B1

(12) United States Patent
Wawrzeniak

(10) Patent No.: US 7,762,041 B1
(45) Date of Patent: Jul. 27, 2010

(54) HYBRID METAL POLE

(75) Inventor: John H. Wawrzeniak, Arlington, TX (US)

(73) Assignee: Valmont Newmark, Inc., Omaha, NE (US)

( * ) Notice: Subject to any disclaimer, the term of this patent is extended or adjusted under 35 U.S.C. 154(b) by 636 days.

(21) Appl. No.: 11/258,984

(22) Filed: Oct. 26, 2005

Related U.S. Application Data

(60) Provisional application No. 60/624,773, filed on Nov. 3, 2004.

(51) Int. Cl.
*E04C 3/00* (2006.01)

(52) U.S. Cl. ..... 52/848; 52/296; 403/359.6

(58) Field of Classification Search ..... 52/831, 52/848, 849, 843, 844, 852, 854, 296, 297, 52/40; 403/359.1, 359.6, 336, 337; 248/159, 248/161, 125.8; 343/875; 174/45 R; 416/DIG. 6; 138/DIG. 11; 29/525.01, 525.14
See application file for complete search history.

(56) References Cited

U.S. PATENT DOCUMENTS

| | | | | | |
|---|---|---|---|---|---|
| 404,232 | A | | 5/1889 | Snead | |
| 1,224,966 | A | | 5/1917 | Schweitzer | |
| 1,524,677 | A | * | 2/1925 | Thompson | 285/302 |
| 1,545,456 | A | | 7/1925 | Rastetter | |
| 2,036,771 | A | * | 4/1936 | Pfistershammer | 52/298 |
| 2,702,103 | A | * | 2/1955 | Pfistershamer | 52/848 |
| 2,848,769 | A | * | 8/1958 | Oakley | 52/848 |
| 2,938,355 | A | * | 5/1960 | Dougherty | 405/250 |
| 2,985,261 | A | * | 5/1961 | Kubesh | 52/120 |
| 3,034,209 | A | * | 5/1962 | Giuseppe et al. | 29/432 |
| 3,071,214 | A | * | 1/1963 | Steinbichler | 285/332.4 |
| 3,147,829 | A | * | 9/1964 | Johnson et al. | 52/115 |
| 3,217,459 | A | * | 11/1965 | Meyer | 52/28 |
| 3,270,480 | A | * | 9/1966 | Beecker | 52/848 |
| 3,421,781 | A | | 1/1969 | Spurk | |
| 3,541,746 | A | * | 11/1970 | Mertz | 52/127.12 |
| 3,571,991 | A | * | 3/1971 | Doocy et al. | 52/40 |
| 3,793,794 | A | * | 2/1974 | Archer et al. | 52/632 |
| 3,814,023 | A | * | 6/1974 | Stantial | 104/94 |
| 3,865,498 | A | * | 2/1975 | Okuto et al. | 403/292 |
| 3,911,548 | A | * | 10/1975 | Perry | 29/402.12 |
| 3,927,497 | A | * | 12/1975 | Yoshinaga et al. | 52/169.1 |
| 3,936,206 | A | * | 2/1976 | Meisberger | 403/334 |
| 3,958,381 | A | * | 5/1976 | Meyer | 52/302.5 |
| 4,033,080 | A | * | 7/1977 | Fukushima | 52/223.4 |
| 4,617,768 | A | | 10/1986 | Gebelius | |
| 4,751,804 | A | * | 6/1988 | Cazaly | 52/651.02 |
| 5,398,478 | A | * | 3/1995 | Gordin et al. | 52/741.14 |
| 5,481,835 | A | * | 1/1996 | Bloom | 52/98 |
| 5,481,846 | A | | 1/1996 | Macchietto | |
| 5,513,477 | A | * | 5/1996 | Farber | 52/848 |
| 5,784,851 | A | * | 7/1998 | Waugh | 52/848 |
| 5,904,004 | A | | 5/1999 | Hill | |

(Continued)

FOREIGN PATENT DOCUMENTS

| | | | |
|---|---|---|---|
| DE | 2708664 | A1 | 9/1977 |

*Primary Examiner*—Richard E Chilcot, Jr.
*Assistant Examiner*—Brent W Herring
(74) *Attorney, Agent, or Firm*—Camoriano and Associates; Theresa Fritz Camoriano

(57) ABSTRACT

A hybrid metal pole includes a substantially circular cross-section thin-walled base portion, a multi-sided upper portion, and a multi-sided transition portion.

17 Claims, 1 Drawing Sheet

U.S. PATENT DOCUMENTS 6,309,143 B1 * 10/2001 Merjan et al. ..... 405/253
6,453,636 B1 * 9/2002 Ritz ..... 52/835
6,468,003 B2 * 10/2002 Merjan et al. ..... 405/253
6,694,698 B2 * 2/2004 Ryan ..... 52/741.1
6,705,058 B1 3/2004 Foust et al.
7,171,793 B2 * 2/2007 Gordin et al. ..... 52/848
D541,956 S * 5/2007 Paharik et ..... D25/126
2001/0013212 A1 * 8/2001 Sanchez et al. ..... 52/736.1
2002/0194794 A1 * 12/2002 Hill et al. ..... 52/40
2006/0225379 A1 * 10/2006 Seidel et al. ..... 52/726.3

* cited by examiner

HYBRID METAL POLE

BACKGROUND OF THE INVENTION

This application claims priority from U.S. Provisional Application Ser. No. 60/624,773, filed Nov. 3, 2004. The present invention relates to relatively thin-walled metal poles, and, in particular, to a hybrid metal pole with a multi-sided, polygonal upper section over a substantially circular lower section. With a thin-walled pole, the wall thickness generally is less than one-tenth of the pole diameter. Note that, while steel is used in the example, the design could be made of other types of metal as well.

While there are many structural benefits to a multi-sided pole, it is very difficult to fabricate such a pole from a very heavy gauge metal. Of course, as the pole becomes larger, the wall thickness must become greater in order to support the pole and its loadings. Due to the difficulty of fabricating multi-sided poles from heavy gauge metal, once the size of the pole requires a heavier gauge material, a circular cross-section generally is used. However, a circular cross-section pole lacks many of the structural advantages of a multi-sided pole.

SUMMARY OF THE INVENTION

The present invention takes advantage of the benefits of both a circular cross-section pole and a multi-sided pole by providing a hybrid metal pole having a substantially circular-profile lower portion, a transition portion which is secured to the lower portion, and a multi-sided, polygonal cross-section upper portion which telescopes over the transition portion.

DESCRIPTION

Figure 1:
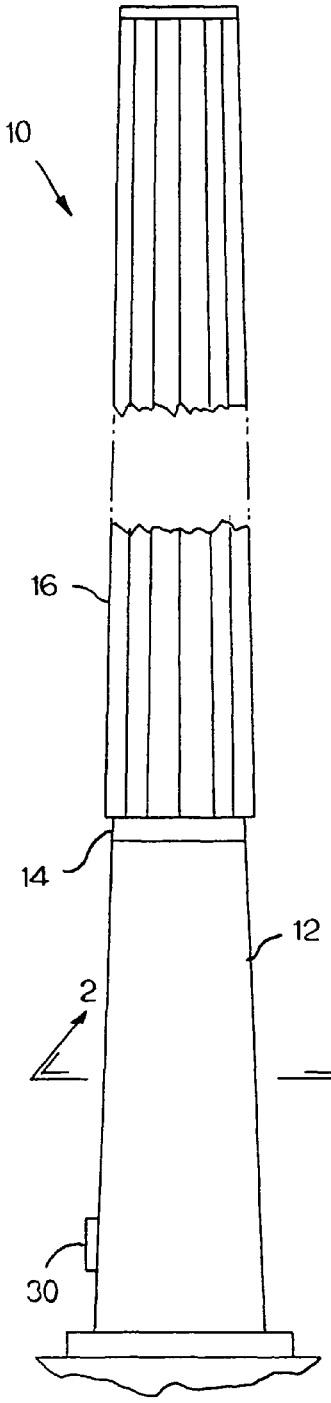
FIG. 1 shows a broken away side view of a hybrid metal pole made in accordance with the present invention.
Figure 2:
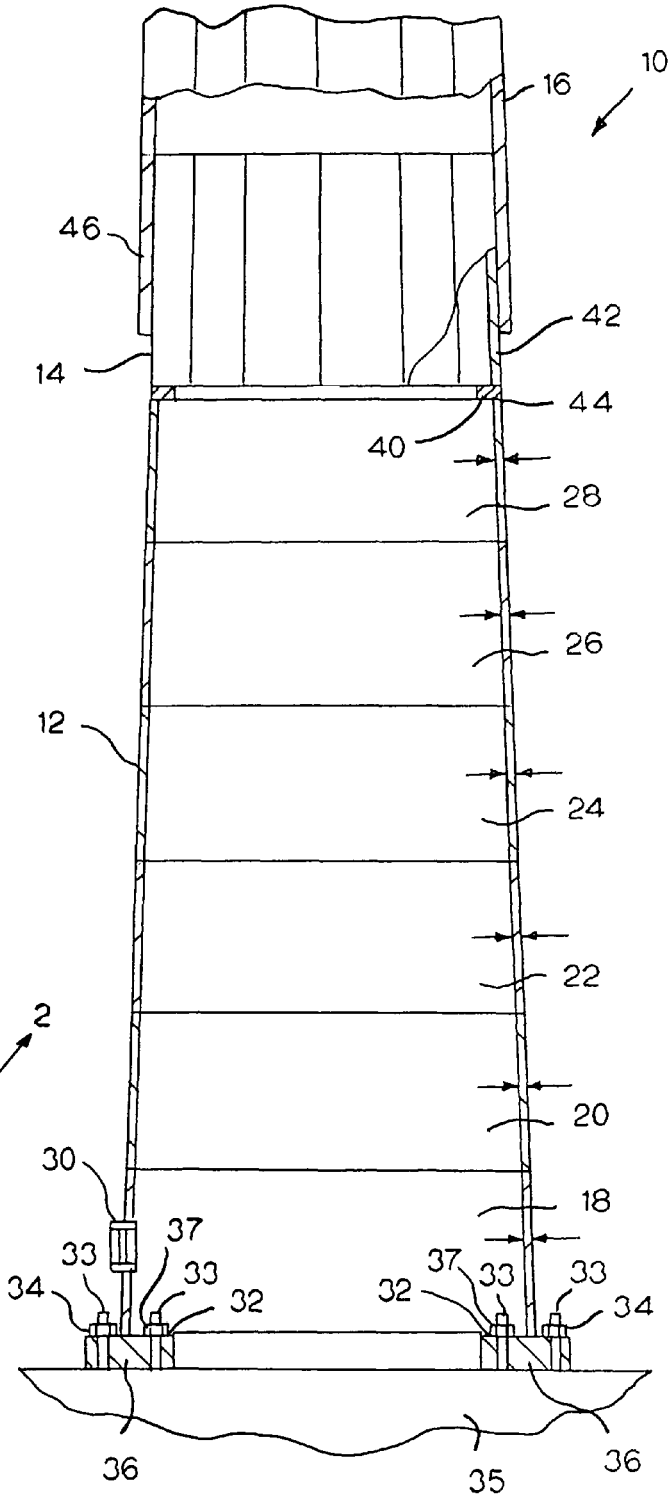
FIG. 2 is a broken away, sectional view along line 2-2 of FIG. 1.

FIGS. 1 and 2 show a first embodiment of a hybrid metal pole 10 made in accordance with the present invention.

Referring to FIGS. 1 and 2, the thin-walled, hollow pole 10 includes a base portion 12 made of a relatively thin-walled shell having a substantially circular cross-section, a transition portion 14, having a multi-sided, polygonal cross-section, and an upper portion 16, also having a multi-sided, polygonal cross-section, which generally matches (or corresponds to) the profile of the transition portion 14, so that the upper portion 16 telescopes over the transition portion 14.

In this embodiment 10, the hollow base portion 12 is fabricated from a plurality of annular sections 18, 20, 22, 24, 26, 28 stacked and welded on top of each other. In this example, each section 18, 20, 22, 24, 26, 28 is 8 to 12 feet tall and has a diameter in excess of 80 inches. The wall thicknesses of these sections 18, 20, 22, 24, 26, 28 may be all the same or they may vary, typically being thicker toward the bottom of the base portion 12. For instance, in this example, the wall thickness of the lowermost section 18 is 1 inch (approximately $1/80^{th}$ of the diameter), the wall thickness of an intermediate section 24 is $15/16$", and the wall thickness of the topmost section 28 is ¾" (approximately $1/110^{th}$ of the diameter).

The base portion 12 may be cylindrical, or it may taper. In this example, it tapers from a wider diameter at the bottom to a smaller diameter at the top. A manway 30 is located on the lowermost section 18 to provide access to the inside of the base portion 12 for certain tasks, including bolting the base portion 12 to a foundation. In this embodiment 10, the base portion 12 includes a base plate 36, which has an inner bolt hole circle 32 and an outer bolt hole circle 34. Bolts 33, which are anchored in the foundation 35, extend upwardly through their respective bolt holes 32, 34 and are secured in place with nuts 37 in order to attach the pole 10 to the foundation. The use of an inside and outside bolt hole circle configuration reduces base plate 36 bending and therefore reduces the base plate 36 thickness requirements. Other foundation mechanisms could also be used, such as an embedded foundation.

The transition portion 14 has a multi-sided, polygonal cross-section, which, in this embodiment 10, provides a twelve-sided profile, which provides the interconnection to the upper portion 16 of the pole 10. Of course, other profiles could be used instead, such as six-sided. As shown in FIG. 2, the transition portion 14 has a base plate or ring 40 welded to its polygonal side wall 42, and the base plate 40 is secured to the topmost section 28 of the base portion 12 via a full penetration circumferential weld 44. Of course, other means for securing the transition portion 14 to the base portion 12 (such as bolting, for instance) may be used. In an embodiment (not shown) in which the transition portion 14 is bolted to the base portion 12, the base portion 12 may have an inwardly-directed flange or an outwardly-directed flange welded at its upper edge, and bolts would extend through the base plate 40 and that flange in order to bolt the transition portion 14 to the base portion 12. The transition portion 14 preferably has a slight taper, having a smaller diameter at the top than at the bottom. As with the base portion 12, the transition portion 14 is hollow and has a relatively thin-walled shell.

The upper portion 16 of the pole 10 also is hollow and includes a thin-walled shell with a multi-sided, polygonal cross-section, which is compatible with and fits over the transition portion 14 with a close fit. Preferably, the upper portion 16 is also tapered, at least at its lower section 46, and is sized such that this lower section 46 is able to slide over and contact a substantial portion of the transition portion 14 until it reaches a point at which the inside diameter of the upper portion 16 is the same as the outside diameter of the transition portion 14, where wedging between the upper portion 16 and the transition portion 14 causes the upper portion to stop, wedging or locking it in place. Since the base portion 12 is bolted to the foundation 35, and the transition portion 14 is welded (or otherwise secured) to the base portion 12, then, when the upper portion 16 telescopes over the transition portion 14 and wedges into place, it provides a positive anti-rotation mechanism to torsional pole loadings. It also provides a positive mechanism for assembling a multi-section pole or tower without requiring the use of intermediate flanges.

In this particular embodiment, the wall thickness and diameter of the upper portion 16 where it joins with the transition portion 14 are ½" and 70", respectively. Also, in this embodiment, the upper portion 16 is twelve-sided, so it matches the shape of the transition portion 14, which is also twelve-sided.

It would be possible for the upper portion 16 to have a different shape from the transition portion 14 while still being compatible so it would mate with the transition portion 14. For example, the upper portion 16 could be six-sided while the transition portion 14 is twelve-sided. In that case, every other face of the transition portion 14 would contact the inner surface of one of the faces of the upper portion 16.

The taper of the transition portion 14 need not necessarily be the same as the taper of the base portion 12. Thus, the transition portion 14 allows for a change in taper from one portion to another within the same pole 10. In this embodiment, the angle of taper of the base portion 12 is greater than the angle of taper of the upper portion 16. In this embodiment, the upper portion 16 covers more than half of the transition portion 14 by the time it reaches the wedged or locked position.

By providing a transition between a multi-sided upper portion and a circular lower portion, this pole 10 is able to take advantage of both types of poles. The pole 10 has a heavier wall thickness in its rounded, circular cross-section base portion 12, enabling it to support a large structure, and, in its upper portion 16, where the wall thickness does not have to be as great, it takes advantage of the structural benefits of a polygonal shape.

The foregoing is intended only as an example of a pole made in accordance with the present invention. It will be obvious to those skilled in the art that various modifications may be made to the embodiment described above without departing from the scope of the present invention.

What is claimed is:

1. A hybrid metal pole, comprising:

a rounded, substantially circular cross-section thin-walled metal base portion defining a lower end and an upper end, and a length extending from the lower end to the upper end, wherein said thin-walled metal base portion has a wall thickness of at least three-fourths of an inch;

a transition portion having a polygonal cross-section side wall with an upper end and a lower end and including a ring welded to the lower end of the polygonal cross-section side wall, said ring being secured to said upper end of said base portion; and a thin-walled metal upper portion having a polygonal cross-section compatible with the cross-section of the transition portion and having upper and lower ends, wherein said lower end of said upper portion mounts over said transition portion with a close fit.

2. A hybrid metal pole as recited in claim 1, wherein at least one of said transition portion and said upper portion is tapered, and said upper portion is wedged onto said transition portion until it stops due to wedging, with no stop mechanism on the upper portion or transition portion to interfere with the wedged stop.

3. A hybrid metal pole as recited in claim 2, wherein said ring of said transition portion is welded onto said upper end of said base portion.

4. A hybrid metal pole, comprising:

a rounded, substantially circular cross-section thin-walled metal base portion defining a lower end and an upper end;

a transition portion having a polygonal cross-section side wall with an upper end and a lower end and including a ring welded to the lower end of the polygonal cross-section side wall, said ring being secured to said upper end of said base portion;

a thin-walled metal upper portion having a polygonal cross-section compatible with the cross-section of the transition portion and having upper and lower ends, wherein said lower end of said upper portion mounts over said transition portion with a close fit; and a base plate secured to said lower end of said base portion, wherein said base plate defines a double bolt-hole circle for releasably securing the pole to a foundation.

5. A hybrid metal pole as recited in claim 4, wherein said double bolt-hole circle includes at least one bolt hole circle located inside said base portion.

6. A hybrid metal pole, comprising:

a rounded, substantially circular cross-section thin-walled metal base portion defining a lower end and an upper end;

a transition portion having a polygonal cross-section side wall with an upper end and a lower end and including a ring welded to the lower end of the polygonal cross-section side wall, said ring being secured to said upper end of said base portion;

a thin-walled metal upper portion having a polygonal cross-section compatible with the cross-section of the transition portion and having upper and lower ends, wherein said lower end of said upper portion mounts over said transition portion with a close fit; wherein said base portion defines a length extending from said lower end to said upper end and a wall thickness, and said wall thickness varies along said length, being thicker at the lower end and thinner at the upper end.

7. A hybrid metal pole as recited in claim 6, wherein at least one of said transition portion and said upper portion is tapered, said upper portion is wedged onto said transition portion, and said ring of said transition portion is welded onto said upper end of said base portion.

8. A hybrid metal pole as recited in claim 7, wherein the outside diameter of said base portion changes along said length, tapering from a larger diameter at the lower end to a smaller diameter at the upper end.

9. A hybrid metal pole as recited in claim 8, wherein said transition portion has a twelve-sided polygonal cross-section.

10. A hybrid metal pole as recited in claim 8, wherein said transition portion has a length and an outside diameter and the outside diameter of the transition portion tapers along the respective length of the transition portion.

11. A hybrid metal pole as recited in claim 10, wherein said upper portion also has a length and an outside diameter and the outside diameter of the upper portion tapers along the respective length of the upper portion, wherein the taper at the lower end of said upper portion substantially corresponds to the taper of said transition portion.

12. A hybrid metal pole as recited in claim 11, wherein said lower end of said upper portion covers more than half of said transition portion when the upper portion is wedged onto the transition portion.

13. A hybrid metal pole as recited in claim 12, wherein said base portion is hollow.

14. A hybrid metal pole, comprising:

a rounded, substantially circular cross-section thin-walled metal base portion defining a lower end and an upper end and a length from said lower end to said upper end;

a foundation means for supporting the pole at said lower end;

a transition portion having a polygonal cross-section side wall with an upper end and a lower end and including a ring welded to the lower end of the polygonal cross-section side wall, said ring being secured to said upper end of said base portion; and a thin-walled metal upper portion having a polygonal cross-section compatible with the cross-section of the transition portion and having upper and lower ends, wherein said lower end of said upper portion mounts over said transition portion with a close fit.

15. A hybrid metal pole as recited in claim 14, wherein said foundation means includes a base plate which defines at least one bolt hole circle.

16. A hybrid metal pole as recited in claim 15, wherein the outside diameter of said base portion changes along said length, tapering from a larger diameter at the lower end to a smaller diameter at the upper end.

17. A hybrid metal pole as recited in claim 16, wherein said transition portion has a length and an outside diameter and the outside diameter of the transition portion tapers along the respective length of the transition portion.

* * * * *